US006721988B2

(12) United States Patent
Woodruff

(10) Patent No.: US 6,721,988 B2
(45) Date of Patent: Apr. 20, 2004

(54) MODULAR PAINT ROLLER

(76) Inventor: Byron J. Woodruff, 9140 Shadyforest Dr. Southwest, Calabash, NC (US) 28467

( * ) Notice: Subject to any disclaimer, the term of this patent is extended or adjusted under 35 U.S.C. 154(b) by 258 days.

(21) Appl. No.: 10/056,673

(22) Filed: Jan. 22, 2002

(65) Prior Publication Data

US 2002/0104181 A1 Aug. 8, 2002

Related U.S. Application Data

(60) Provisional application No. 60/266,090, filed on Feb. 2, 2001.

(51) Int. Cl.[7] ..... B05C 17/02; B05C 01/08

(52) U.S. Cl. ..... 15/230.11; 492/13; 492/19

(58) Field of Search ..... 15/230.11, 143.1; 492/13, 16

(56) References Cited

U.S. PATENT DOCUMENTS

| | | | | | |
|---|---|---|---|---|---|
| 2,747,210 | A | * | 5/1956 | Canning et al. | 15/230.11 |
| 3,419,931 | A | * | 1/1969 | Willig | 15/144.1 |
| 3,520,628 | A | * | 7/1970 | Moceri | 15/230.11 |
| 4,196,491 | A | * | 4/1980 | Baril | 15/230.11 |
| 4,237,575 | A | | 12/1980 | Mlachnik | 15/230.11 |
| 4,320,553 | A | * | 3/1982 | Charles | 15/230.11 |
| 4,597,684 | A | * | 7/1986 | O'Brien et al. | 401/197 |
| 6,256,828 | B1 | | 7/2001 | Sauer | 15/143.1 |

FOREIGN PATENT DOCUMENTS

| | | | |
|---|---|---|---|
| FR | 1083930 | * | 6/1954 |

* cited by examiner

*Primary Examiner*—Robert J. Warden, Sr.
*Assistant Examiner*—Laura C Cole
(74) *Attorney, Agent, or Firm*—Thomas Schneck

(57) ABSTRACT

A paint roller having modular, rebuildable sections including a hollow tubular handle terminating in a cylindrical end connected to an offset midsection and a roller spindle rod. The offset midsection includes a pair of clamps at opposed ends. The first clamp includes a clamp body with a slotted opening and a collar having an opening within which said cylindrical end is received. A screw passing through the clamp body and collar is turned to retract the collar into the slotted opening thus locking the handle to the midsection. A second clamp includes a clamp housing with a threadable opening, a plastic bushing transverse to the threadable opening and a spindle rod having ridges passing through the plastic bushing. A set screw is insertable within the threadable opening, pushing a plastic surface of the plastic bushing into the ridges and locking the spindle rod to the clamp and attached midsection.

23 Claims, 7 Drawing Sheets

MODULAR PAINT ROLLER

RELATED APPLICATIONS

This application claims the benefit of U.S. Provisional Patent Application Ser. No. 60/266,090, filed Feb. 2, 2001.

TECHNICAL FIELD

The invention relates to paint rollers and more particularly to a rebuildable, readily cleanable, paint roller.

BACKGROUND ART

Heretofore, paint rollers were inexpensive, disposable devices which were not intended for long term use. Paint rollers eventually become caked with paint or paint debris and become unusable. These paint rollers were then discarded and replaced by new paint rollers.

The object of the present invention was to devise a rebuildable roller for long term durability and use.

SUMMARY OF THE INVENTION

The paint roller of the present invention features a roller body construction in modular, rebuildable sections. The sections include a hollow tubular handle terminating in a cylindrical end connected to an offset midsection and a roller spindle rod. A pair of clamps are featured at opposed ends of the offset midsection. One clamp features a screw collar, which is retractable into a slotted opening, for forming a secure grip onto the cylinder of the tubular handle. A screw turns the movable collar retracting it into the slotted opening of the clamp. The opposed end features a clamp atop the midsection. The clamp includes a plastic bushing in a hole, transverse to a set screw, accommodating a linear shaft or spindle rod on which the roller resides. The spindle rod has a small flange at one end for retaining a roller element and very small ridges at the opposite end. The spindle rod fits into the plastic bushing in the clamp. The set screw in the clamp slightly deforms the plastic of the plastic bushing, pushing the plastic into the ridges, locking the spindle rod to the clamp without galling the spindle. Both clamps may be removed and replaced. Similarly, the handle, midsection and spindle rod may be removed and replaced, as for cleaning. Stainless steel or aluminum construction allows the device to be easily cleaned with the roller removed. The roller is replaced from time to time by removing solid TEFLON® end caps, with central spindle apertures. Use of TEFLON® discourages paint from sticking to the end caps and provides another material which can be easily cleaned.

DETAILED DESCRIPTION OF THE INVENTION

Figure 1:
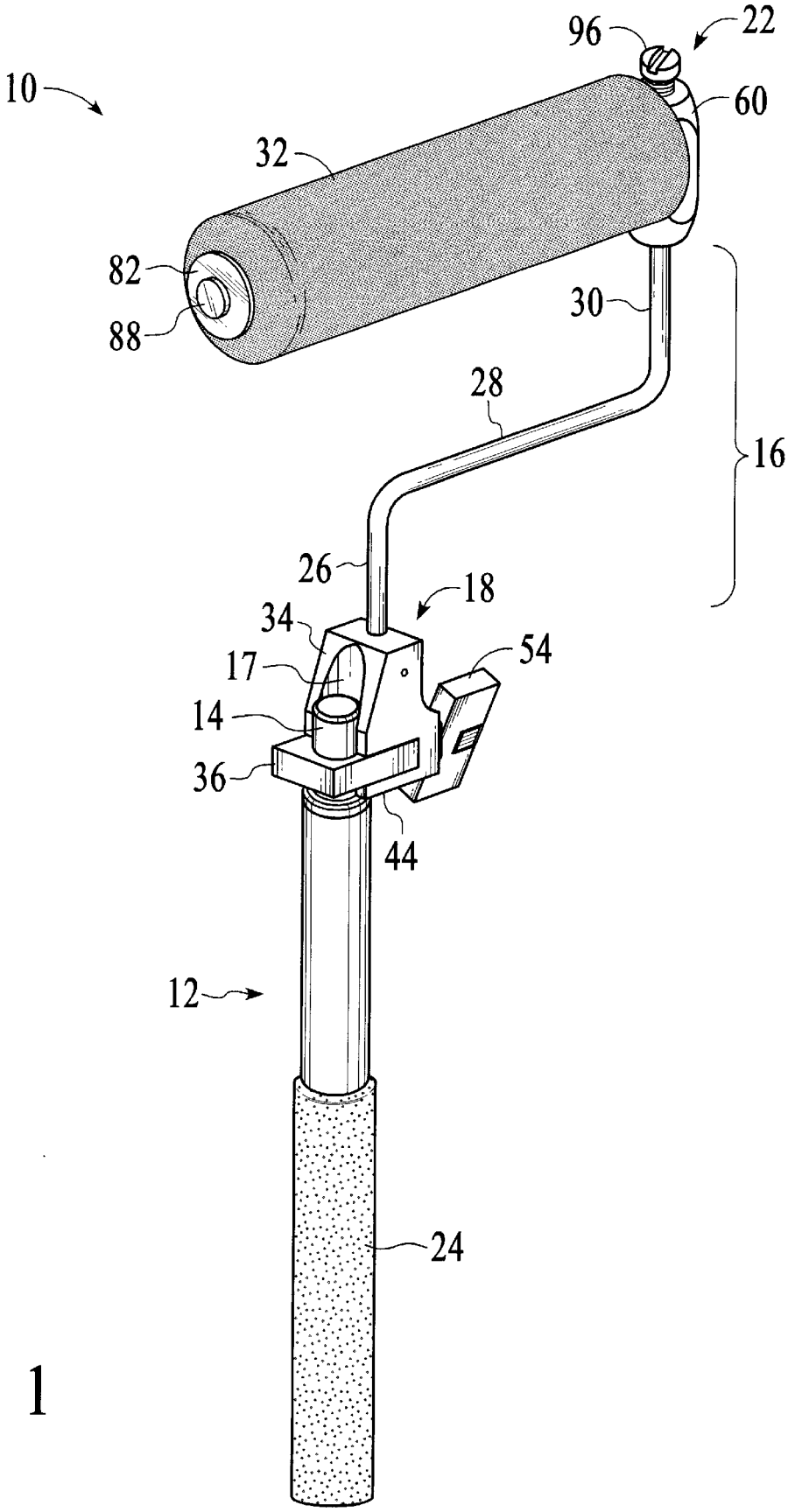
FIG. 1 is a perspective view of the paint roller of the present invention.
Figure 2:
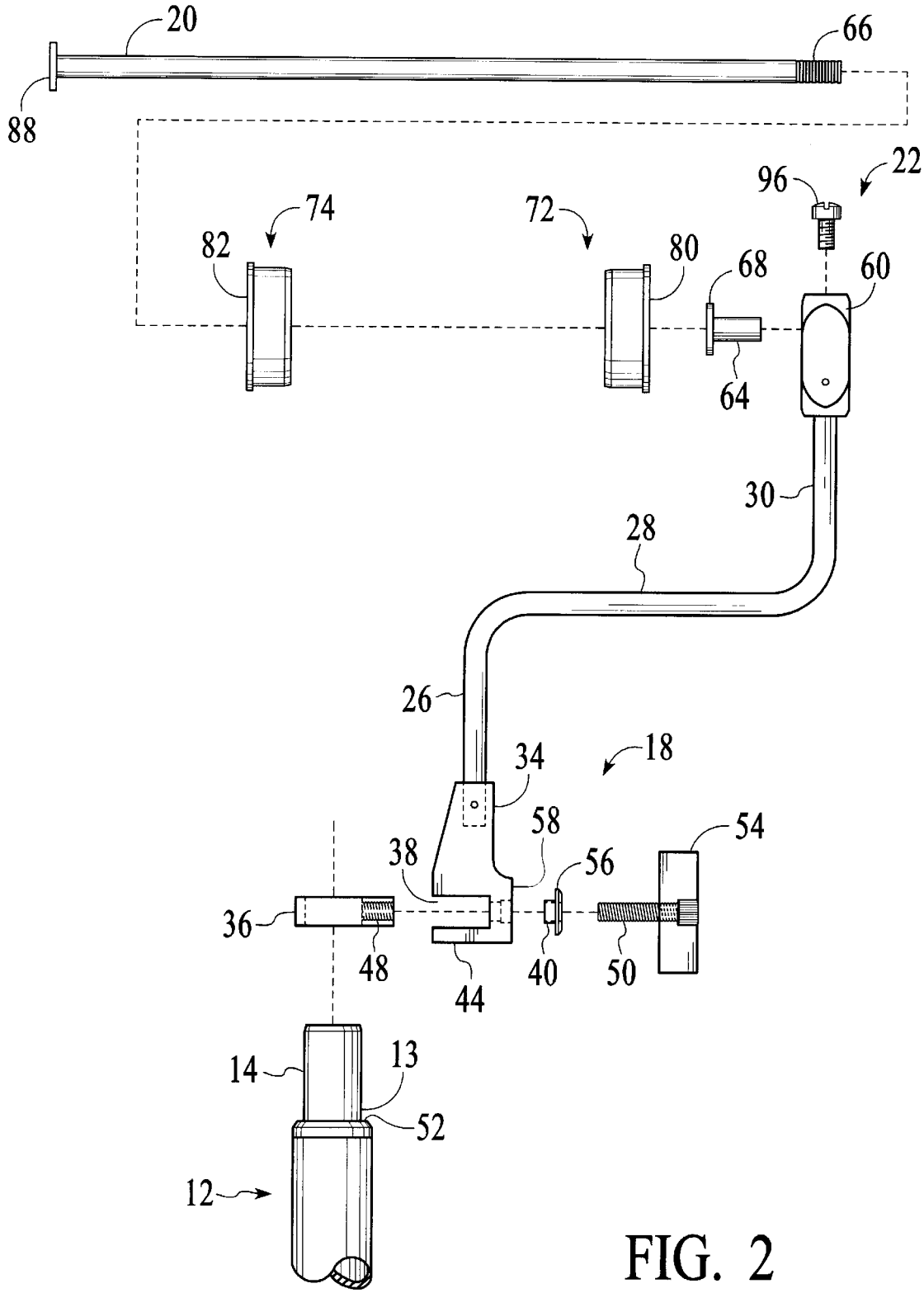
FIG. 2 is an exploded view of the paint roller of FIG. 1 without the roller.
Figure 3:
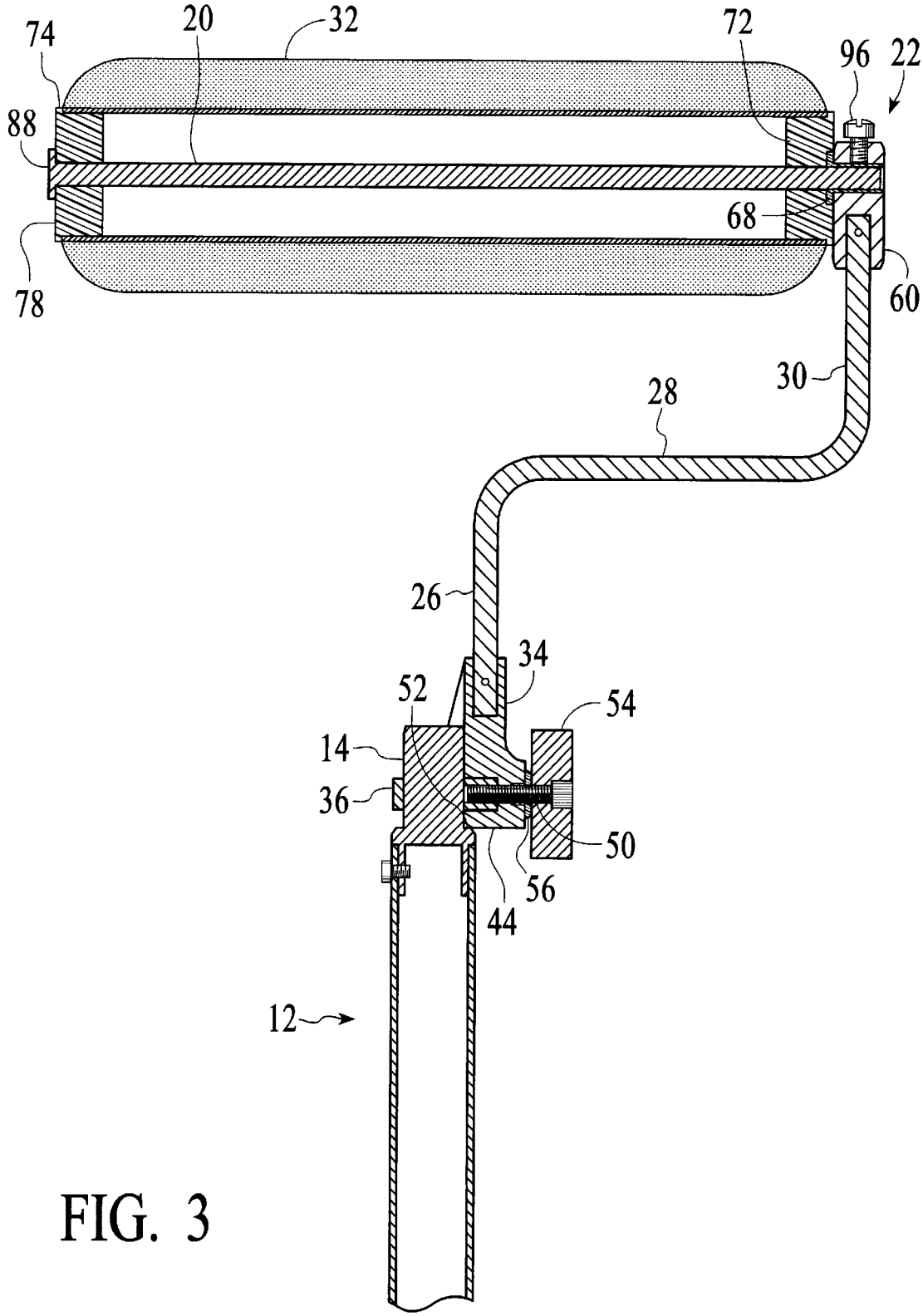
FIG. 3 is a cross sectional view of the paint roller of FIG. 1.
Figure 4:
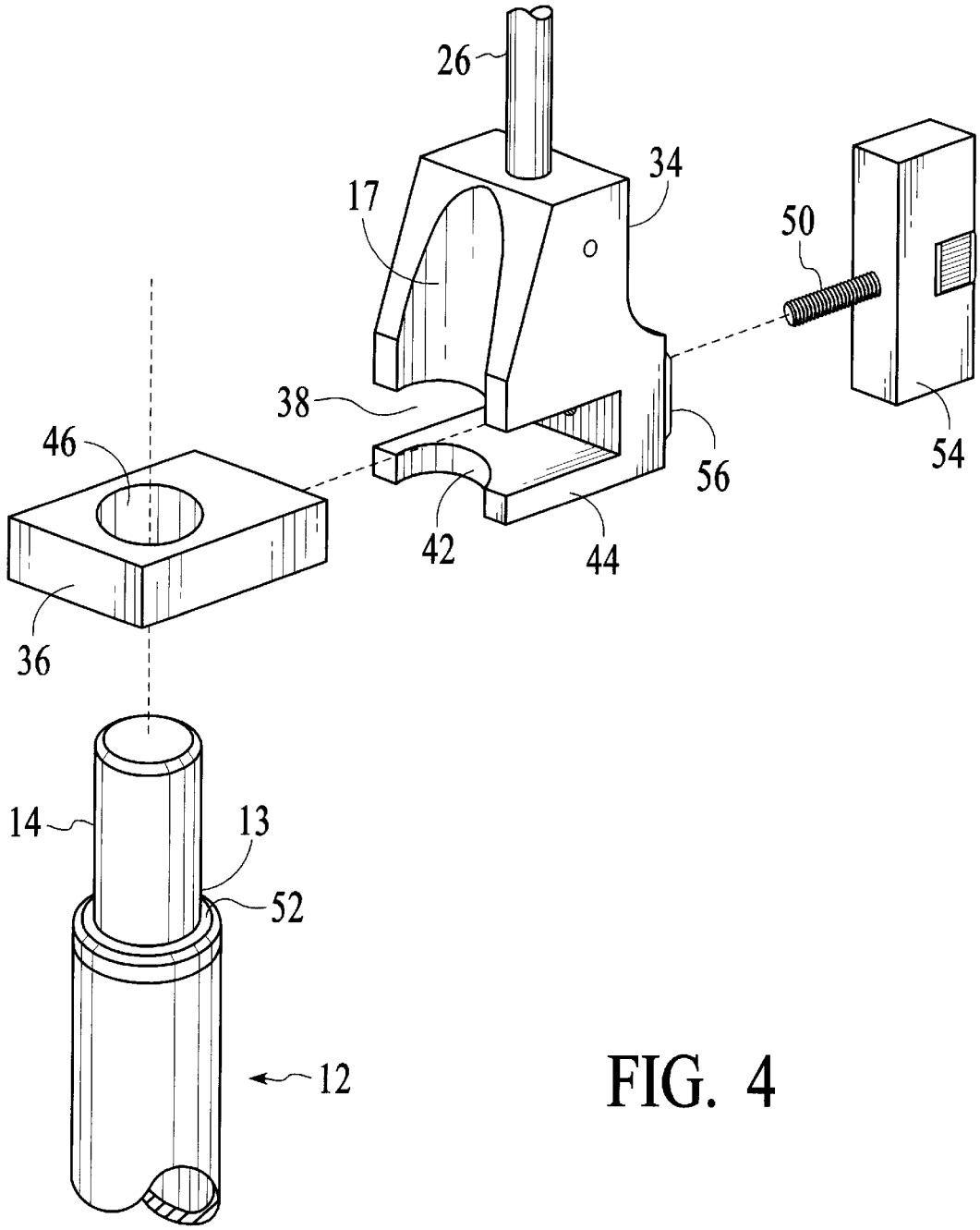
FIG. 4 is an exploded view of a clamp shown in the paint roller of FIGS. 1–3.

With reference to FIGS. 1 and 2 it is seen that the paint roller 10 of the present invention includes a handle 12 terminating in a cylinder or cylindrical end 14, the cylindrical end 14 secured to a midsection 16, for example an offset midsection, through a first clamp 18. The offset middle section 16 is secured to a roller spindle rod 20 through a second clamp 22. The handle may include an attached handle grip 24 for ease in gripping the handle. The grip 24 is made of, for example, a rubber or plastic material that provides comfort to the user. In one embodiment the handle 12 is tubular in shape and the cylindrical end 14 is solid.

The midsection 16 includes a section 26 that extends a distance parallel to the handle 12, a laterally transverse section 28, and another section 30, parallel to the handle. The laterally transverse section 28 leads to the parallel section 30 and connects the two parallel sections 26 and 30 together. Parallel section 30, is secured to the spindle rod 20, insertable within a roller 32, through the second clamp 22. The roller 32 is, for example, a type known in the art. Roller 32 is described in more detail below.

With reference to FIGS. 1 to 4, it is seen that the first clamp 18 includes a clamp body 34 attached to the parallel section 26 and secured to the cylindrical end 14 through a movable collar 36. The clamp body 34 has a slotted opening 38 and a bushing 40, for example a plastic bushing, terminating at the slot 38. A cutout 42, shaped to receive a lower portion 13 of the cylindrical end 14, is disposed within a lower bracket 44 of the clamp body 34. An indentation 17 shaped to receive another portion of the cylindrical end 14 is disposed along a length of the clamp body 34.

The collar 36 includes an opening 46 through which the cylindrical end 14 is insertable and a threaded opening 48 and terminating at the collar opening 46. A screw 50 is threadably insertable within the bushing 40 and opening 48 and the cylindrical end 14 is insertable within the cylindrical opening 46.

The cylindrical end 14 is also partially insertable within the cutout 42 and a portion of the cylindrical end 14 rests within the indentation 17 upon locking the clamp 18.

To accomplish locking, the collar 36, receiving the cylindrical end 14, is partially inserted within the slot 38. The lower bracket 44 rests upon an axial seat 52 of the handle 12. The axial seat 52 is disposed at a location where the cylindrical end 14, having a smaller diameter than the rest of the handle 12, meets the rest of the handle 12. As the screw 50 is inserted within the bushing 40 and is turned into the opening 48, the movable collar 36 is retracted further into the slotted opening 38 of the clamp 18, forming a secure connection between the midsection 16 and the handle 12.

In one embodiment the screw 50 is inserted within an opening (not shown) within a finger tightening stem 54. As the finger tightening stem 54 is turned so is the screw 50 within it, retracting the movable collar 36 within the slotted opening 38 of the clamp body 34 as described above. In one embodiment, finger tightening stem 54 is a one piece unit having a threadable portion extending from it for insertion within the bushing 40. The finger tightening stem 54 provides for user ease in turning the screw 50 with his or her fingers. In one embodiment, a plastic ring 56 is secured to an outer surface 58 of the clamp body 34, so the finger tightening stem 54 makes contact with the ring 56 and not the outer surface 58, preventing galling of the clamp surface and the finger tightening stem 54 as the finger tightening stem is turned. The plastic ring 56 is, in one example, attached (as shown in FIG. 2) to the plastic bushing 40 or, in another example, not attached to the plastic bushing 40.

Figure 5:
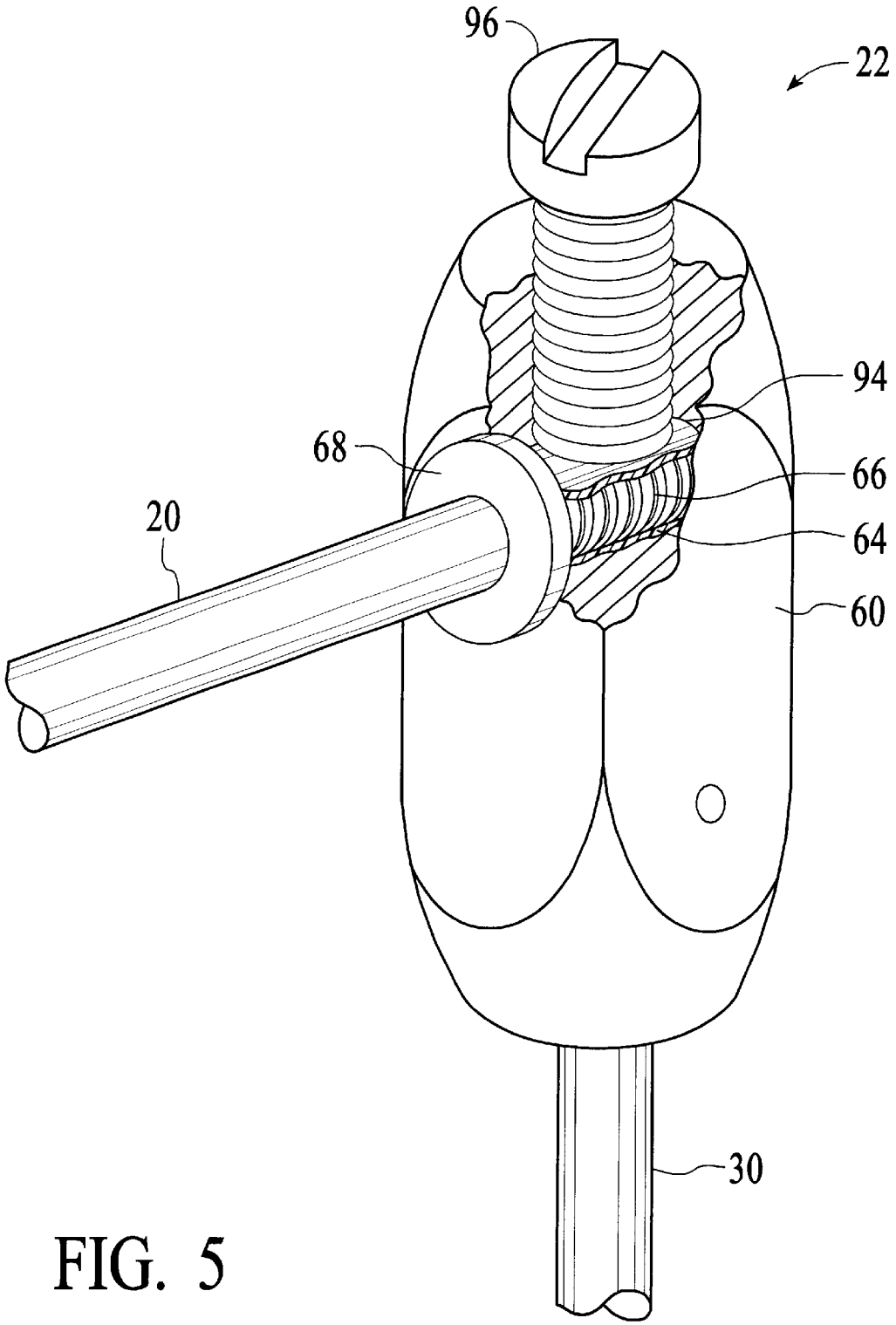
FIG. 5 is a cutaway view of a clamp shown in FIGS. 1–3.
Figure 6:
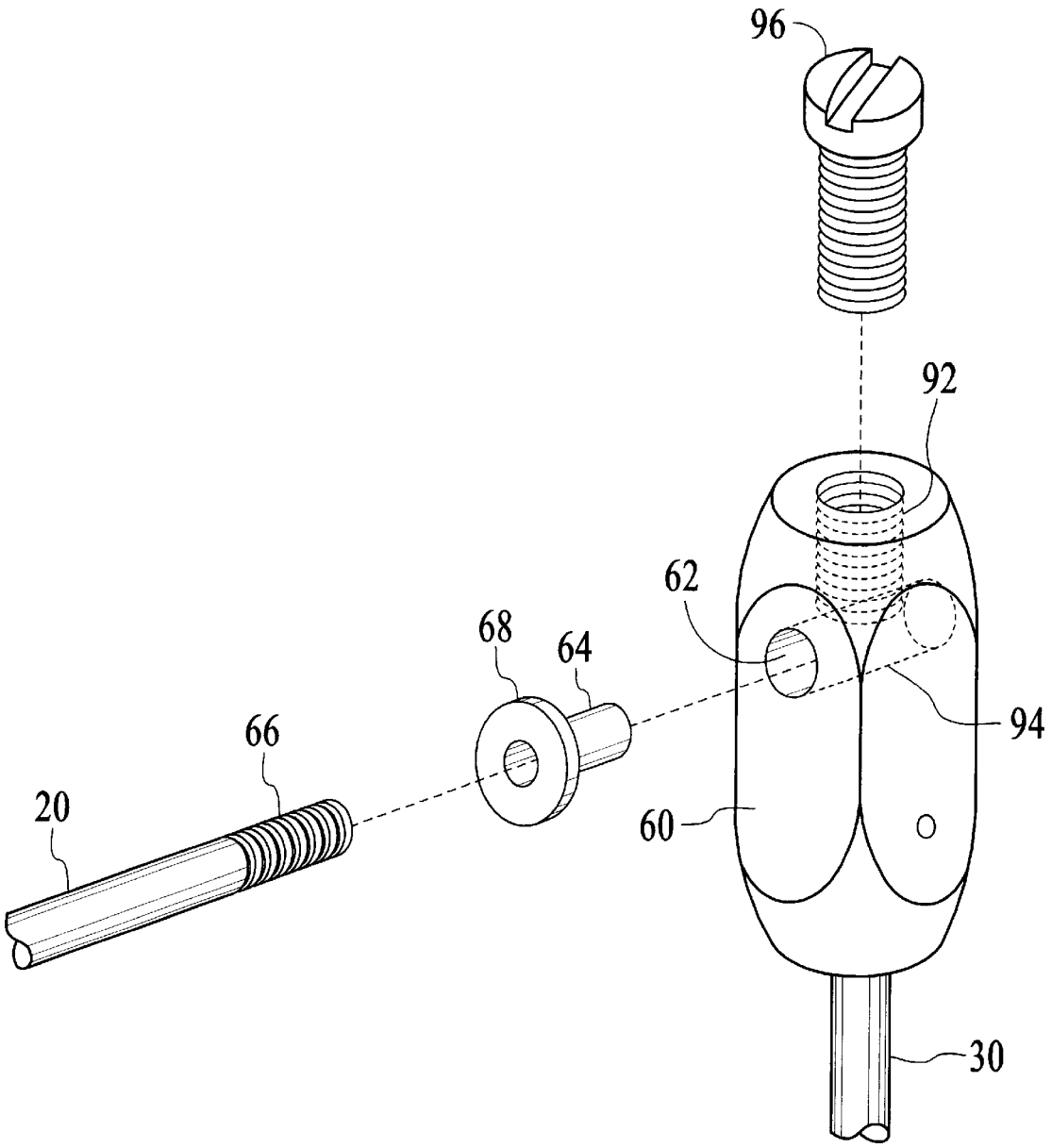
FIG. 6 is an exploded view of the clamp shown in FIG. 5.
Figure 7:
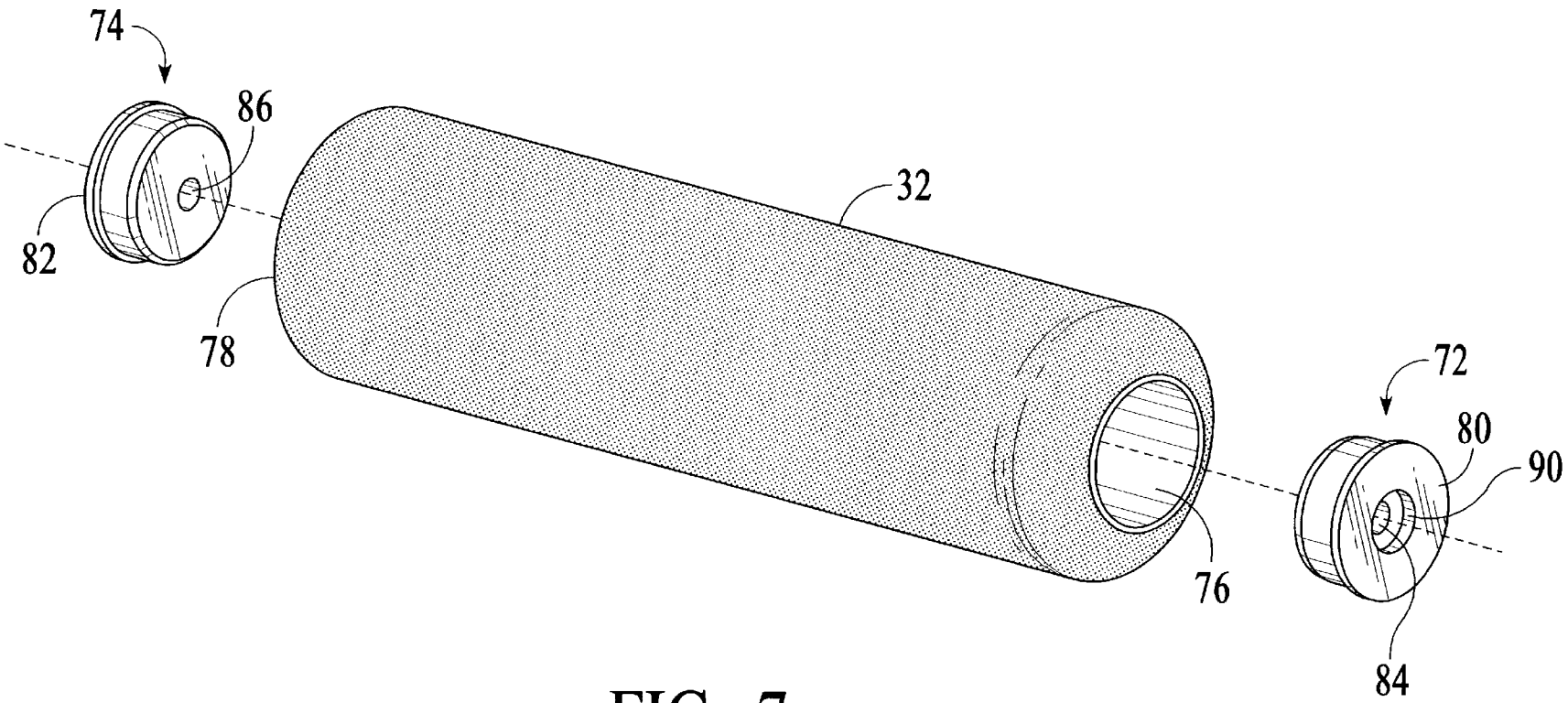
FIG. 7 is an exploded view of a roller shown in FIGS. 1 and 3 and end caps shown in FIGS. 1–3.

With reference to FIGS. 1–3 and FIGS. 5–6 there is seen the second clamp 22 atop the midsection 16. The second clamp 22 includes a clamp housing 60 that is connected to parallel section 30. A hole 62, transverse to a threaded opening 92, is disposed through the second clamp 22. A plastic bushing 64 is disposed within the transverse hole 62 and an end of the spindle rod 20, including ridges 66, is insertable within the plastic bushing 64. A plastic ring 68 contacts an outside surface of housing 60. The plastic ring 68 is, in one example, attached to the plastic bushing 64 (as shown in FIG. 6) or, in another example, is not attached to the plastic bushing 64.

With reference to FIGS. 1–3 and 7, it is seen that end caps 72 and 74 are received within a pair of roller openings of the roller 32. The first opening 76 is seen. The second opening is not shown, but is of the same shape and size as opening 76 and is disposed near surface 78. In one example the end caps 72 and 74 are solid. In another example end caps comprise TEFLON®, a material that is easily cleaned. End cap 72 includes an axial flange 80 and end cap 74 includes an axial flange 82. Axial flanges 80 and 82 rest upon an outer surface of the roller opening upon insertion of the end cap 72 into the roller opening 76 and the end cap 74 into the other opening (not shown). The flanges prevent the end caps 72 and 74 from falling within the openings or the roller 32 from falling off the spindle rod 20.

End caps 72 and 74 also include central spindle apertures 84 and 86, respectively, through which the spindle rod 20 is inserted. Flange 88 at one end of rod 20 presses up against an outer surface of the end cap 74 surrounding the aperture 86 and prevents the rod 20 from sliding out of the roller 32 and off of the end cap 74. End cap 72 includes a cutout 90 surrounding the aperture 84 shaped to receive the plastic ring 68. Plastic ring 68, secured to clamp housing 60 as described above, pushes up against a surface of the cutout 90 of end cap 72 preventing galling of the clamp housing 60 or of end cap 72.

In one embodiment the end caps 72 and 74 are first inserted into the roller openings. Then the spindle rod 20 is inserted within the apertures of the end caps 72 and 74, the end having the ridges 66 being inserted first through aperture 86 and then 84.

With reference to FIGS. 5 and 6 it is seen that the threaded opening 92 extends partially through the housing 60 terminating at an upper surface 94 of the plastic bushing 64. An axle set screw 96 is threadably insertable within the threaded opening 92 of the clamp 22. In one embodiment the set screw 96 is headless and includes the threaded portion. As the set screw 96 is turned, the set screw 96 contacts the upper plastic bushing surface 94 and slightly deforms the plastic, pushing the plastic into the ridges 66 thus locking the spindle rod 20 to the clamp 22 without galling the spindle rod 20.

The roller 32 is replaced from time to time by turning the set screw 96, removing the spindle rod 20 from the clamp housing 60 and removing the solid Teflon end caps 72 and 74 from the roller openings. In one embodiment, to install or remove a roller 32 or to replace or remove the end caps 72 and 74 for cleaning, the axle set screw 96 need only be loosened approximately a quarter turn.

The present invention is advantageous in that both clamps 18 and 22 may be easily removed for cleaning and if necessary replaced. Similarly the handle 12, midsection 16, spindle rod 20 may be removed and replaced or removed for cleaning and re-installed. The handle 12, midsection 16, spindle rod 20 and clamps 18 and 22 are comprised of, for example, non-corrosive materials such as stainless steel or aluminum. With the stainless steel or aluminum construction, the device may be easily cleaned once the roller 32 is removed. Additionally, stainless, steel and aluminum provide for a durable, long lasting roller 32.

The size of the parts of the paint roller 10 for example, the handle 12, midsection 16, spindle rod 20, clamps 18 and 22, and end caps 72 and 74 vary as desired.

What is claimed is:

1. A paint roller comprising:

a handle terminating in a cylindrical end, a midsection which extends a distance parallel to the handle, then has a laterally transverse section leading to another section parallel to the handle and extending away therefrom, a pair of clamps on opposed ends of said midsection including a first clamp which has a movable, tightenable collar for locking the midsection to the cylindrical end of the handle and a second opposed clamp atop the midsection allowing a spindle rod to pass therethrough in a direction perpendicular to the cylindrical end of the handle, the second clamp having a plastic bushing therein through which the spindle rod passes, the spindle rod having ridges on an end thereof and the second clamp having a set screw which deforms said plastic bushing into the ridges thereby protecting the spindle rod from galling, and a roller mounted on the spindle rod and secured by opposed end caps having holes therein for accommodating the spindle rod.

2. The apparatus of claim 1 wherein said sections are made of non-corrosive materials.

3. The apparatus of claim 2 wherein said non-corrosive materials comprise stainless steel or aluminum.

4. The apparatus of claim 1 wherein said cylindrical end is solid.

5. The apparatus of claim 1 further comprising a grip surrounding a portion of said handle.

6. The apparatus of claim 1 wherein said first clamp includes a clamp body extending from a first end of said midsection and having a slot within which said collar is retractable.

7. The apparatus of claim 6 wherein said clamp body includes an indentation along a length of said body within which said cylindrical end rests upon locking.

8. The apparatus of claim 6 wherein said collar includes a first opening extending through said collar within which said cylindrical end is insertable, a threadable opening in said collar terminating at said first opening at one end, a bushing extending through said clamp body, and a screw insertable within said bushing and threadably insertable within said threadable opening.

9. The apparatus of claim 8 wherein said cylindrical end has a smaller diameter than a remainder of said handle, thereby forming an axial seat wherein said clamp body rests upon said seat.

10. The apparatus of claim 9 wherein said clamp body includes a lower bracket having a cutout shaped to receive a portion of said cylindrical end and wherein said lower bracket rests upon said seat upon locking.

11. The apparatus of claim 8 further comprising a finger tightening stem having an opening within which said screw is inserted.

12. The apparatus of claim 11 further comprising a plastic ring secured to an outer surface of said clamp body and surrounding said bushing wherein said stem is in contact with said plastic ring upon locking.

13. The apparatus of claim 1 wherein said second clamp includes a clamp housing having a side opening and said spindle rod is insertable through said opening.

14. The apparatus of claim 13 further comprising a plastic ring secured to an outside surface of said clamp housing and surrounding said opening, said ring received by said end cap.

15. The apparatus of claim 13 wherein said midsection extends from a lower opening of said clamp housing.

16. The apparatus of claim 13 wherein said clamp housing includes an upper opening extending partially through said housing and terminating at a surface of said plastic bushing, said set screw insertable within said opening.

17. The apparatus of claim 1 wherein said end cap is solid.

18. The apparatus of claim 1 wherein said spindle rod terminates in a flange at another end.

19. The apparatus of claim 1 wherein said handle is partially hollow.

20. A paint roller comprising:

a handle terminating in a cylindrical end, a roller mounted on a spindle rod secured by opposed end caps, and having holes therein for accommodating the end caps, a midsection connecting said handle and said roller, a clamp body attached to a first end of said midsection and having a lower bracket with a cutout receiving a portion of said cylindrical end, a slot within said body receiving a portion of a collar, a bushing in said clamp body terminating at said slot, said collar having an opening through which said cylindrical end is receivable and a threadable opening terminating at said cylindrical end opening, a screw insertable within said clamp body bushing and said threadable opening, locking said collar to said clamp body, and a second clamp body at another end of said midsection, the spindle rod to insertable therethrough in a direction perpendicular to the cylindrical end of the handle, and a threaded opening therein through which a set screw is threadable, thus securing the spindle rod to the clamp body.

21. The apparatus of claim 20 further comprising a plastic bushing through which the spindle rod passes.

22. The apparatus of claim 21 wherein the spindle rod has ridges on an end thereof, wherein said set screw deforms said plastic bushing into the ridges thereby protecting the spindle rod from galling.

23. A paint roller comprising:

a handle terminating in a cylindrical end, a roller mounted on a spindle rod secured by opposed end caps and having holes therein for accommodating the spindle rod, a midsection connecting said handle and said spindle rod, a pair of clamps on opposed ends of said midsection including a first clamp which has a movable, tightenable collar for locking the midsection to the cylindrical end of the handle and a second opposed clamp atop the midsection allowing the spindle rod to pass therethrough in a direction perpendicular to the cylindrical end of the handle, the second clamp having a plastic bushing therein through which the spindle rod passes, the spindle rod having ridges on an end thereof and the second clamp having a set screw which deforms said plastic bushing into the ridges thereby protecting the spindle rod from galling.

* * * * *